United States Patent [19]

Krebser et al.

[11] Patent Number: 4,527,610

[45] Date of Patent: Jul. 9, 1985

[54] CENTRIFUGAL CASTING MACHINE WITH MEANS FOR BALANCING BY INTERCONNECTION OF BALANCING MASS AND MUFFLER HOLDER

[76] Inventors: Werner Krebser, Im Haller 17, 8424 Embrach, Switzerland; Karl H. Schmidt, Binzastrasse 531, 9493 Mauren, Liechtenstein

[21] Appl. No.: 536,381

[22] Filed: Sep. 27, 1983

[30] Foreign Application Priority Data

Sep. 29, 1982 [CH] Switzerland ..... 5721/82

[51] Int. Cl.[3] ..... B22D 13/00; B22D 13/04

[52] U.S. Cl. ..... 164/287; 164/289

[58] Field of Search ..... 164/286, 287, 114, 289

[56] References Cited

U.S. PATENT DOCUMENTS 1,976,654 10/1934 Carpenter ..... 164/287
2,037,617 4/1936 Carpenter ..... 164/287
2,992,463 7/1961 Berger ..... 164/287 X

FOREIGN PATENT DOCUMENTS 2020910 11/1971 Fed. Rep. of Germany .
2932543 2/1980 Fed. Rep. of Germany .

OTHER PUBLICATIONS

Tiegelschleuder TS3 of Degussa Corporation.

*Primary Examiner*—Nicholas P. Godici
*Assistant Examiner*—Kenneth F. Berg
*Attorney, Agent, or Firm*—Werner W. Kleeman

[57] ABSTRACT

Due to the inclination of a centrifuge arm of a centrifugal casting arrangement the mass of a muffle or retort and a compensation or balancing mass come to lie essentially in the same rotational plane. The infinite adjustment of a muffle or retort holder and the compensation or balancing mass is accomplished by a drive rod movably arranged within the centrifuge arm as well as by a gear rack driven by the drive rod and upon which there is seated the muffle holder. A housing structure containing a cover member prevents access to the centrifugal casting arrangement during operation of the centrifugal casting machine.

5 Claims, 2 Drawing Figures

CENTRIFUGAL CASTING MACHINE WITH MEANS FOR BALANCING BY INTERCONNECTION OF BALANCING MASS AND MUFFLER HOLDER

BACKGROUND OF THE INVENTION

The present invention relates to a new and improved construction of centrifugal casting arrangement for a centrifugal casting machine, especially for dental applications, as well as to an improved construction of housing structure for use in such centrifugal casting machine.

Centrifugal casting machines of the aforementioned general type are well known in the art. For instance, centrifugal casting machines suitable for use in dentistry have been disclosed, for instance, in German Patent Publication No. 2,020,910, published Nov. 18, 1971, German Patent Publication No. 2,932,543, published Feb. 14, 1980, and the published brochure of the well known German company Degussa Corporation, entitled "Tiegelschleuder Ts 3". Such type of centrifugal casting machines are typically used in dental laboratories for fabricating artificial dentures or parts thereof, such as prosthesis and cast parts formed of noble metals or replacement materials. Seated upon a centrifuge or centrifugal arm of such centrifugal casting machine is a muffle or retort holder which can be elevationally adjusted and serving for supporting casting muffles or retorts of different sizes. Also seated upon such centrifuge arm is a compensation or balancing mass which can be locked at appropriate positions upon the centrifuge arm in accordance with the momentarily employed muffle mass. Additionally, such type of centrifugal casting equipment uses a melting crucible or a melting trough. Both the muffle holder and the compensation mass or weight, depending upon the size of the muffle or retort, must be placed in a correct position, in order to eliminate as far as possible any imbalance during the centrifugal casting operation.

With such state-of-the-art equipment the centrifuge or centrifugal arm is secured in horizontal position upon a vertical shaft or axle of a drive element, for instance a spiral spring or a drive motor and optionally accommodated within a housing. Such known constructions of centrifugal casting machine no longer fulfil the present day requirements as concerns protection against accidents and ease in operation. The tightening of the drive spring of the centrifuge arm, the manipulations carried out at such centrifuge arm when the spring is tensioned as well as the operation of the centrifugal casting machine, is dangerous. Additionally, particularly in the case of motor-driven centrifugal casting machines, the compensation or balancing mass is not adjusted by the operating personnel to the size of the momentarily employed muffle or retort. Hence, due to the high circumferential velocity of the centrifuge arm the entire centrifugal casting machine is markedly mechanically loaded because of the prevailing imbalance, and hence must be mounted in an extremely solid or sturdy fashion in order to avoid the production of faulty castings due to the vibrations which arise.

SUMMARY OF THE INVENTION

Therefore, with the foregoing in mind it is a primary object of the present invention to provide a new and improved construction of centrifugal casting arrangement for a centrifugal casting machine which is not associated with the aforementioned drawbacks and limitations of the prior art proposals.

Another and more specific object of the present invention aims at the provision of a new and improved construction of centrifugal casting arrangement, especially for use in dentistry, which avoids the previously explained disadvantages.

Yet a further important object of the present invention is concerned with the provision of a new and improved construction of centrifugal casting machine which allows use by the operating personnel without any danger thereto as well as good accessibility and ease of handling the centrifugal casting machine.

A further important object of the present invention is directed to a new and improved construction of housing structure for use in such centrifugal casting machine.

Another noteworthy object of the present invention is directed to a new and improved construction of centrifugal casting machine, especially for dental applications, which is relatively simple in construction and design, quite economical to manufacture, extremely reliable in operation, not readily subject to breakdown or malfunction, requires a minimum of maintenance and servicing, and can be easily and safely used by the operator.

Now in order to implement these and still further objects of the invention, which will become more readily apparent as the description proceeds, the centrigual casting arrangement for a centrifugal casting machine as contemplated in the present development, especially for use in dental applications, is manifested by the features that there is provided a drive shaft, at the end or end region of which there is secured a centrifuge or centrifugal arm. A muffle or retort holder is arranged at one end or end region of the centrifuge arm so as to be movable essentially in vertical direction. A compensation or balancing mass or weight is arranged for displacement along the other end or end region of the centrifuge arm. This compensation or balancing mass serves to compensate for imbalances which may arise when working with different sizes of casting muffles or retorts. There is also provided a melting crucible which is arranged upon the centrifuge arm and cooperates with the casting muffle or retort. Importantly, the muffle holder or support and the balancing mass are drivingly interconnected with one another by drive connection means in such a manner that during the adjustment or setting of the muffle holder to the size of the momentarily used or mounted casting muffle along an essentially vertically disposed rod member for the purpose of accommodation to the position of a casting opening or orifice of the melting crucible, the balancing mass or weight is synchronously displaced to a location of the centrifuge arm which compensates for the mass or weight of the muffle.

As already mentioned previously, the present invention is not only concerned with such improved centrifugal casting arrangement for a centrifugal casting machine but also relates to a new and improved housing structure for such centrifugal casting machine. This housing or housing structure contains a cover member and a drive for the centrifugal casting arrangement of the centrifugal casting machine. The centrifugal casting arrangement and its drive or drive means are operatively coupled with the cover member by means of a timing element or time-switching mechanism arranged in a control cabinet in such a manner that by closing the cover member the drive of the centrifugal casting arrangement is placed into operation for a predetermined adjustable time and after expiration of such time there must first expire an additional amount of time during which there is completely stopped the centrifugal casting arrangement and following which the cover member can be raised to permit access to the centrifugal casting arrangement located in the housing structure of the centrifugal casting machine.

The drive connection means which establishes an operative interconnection between the elevational adjustment of the muffle or retort holder for accommodation of the muffle size and the balancing mass located at the opposite end of the centrifuge arm, precludes the occurrence of errors which could otherwise cause damage to parts of the drive and require a rigid attachment or mounting of the centrifugal casting machine.

Due to the inclined arrangement of the centrifuge or centrifugal arm, according to a preferred embodiment of the invention, there is obviated the need to resort to further complicated measures for preventing the aforementioned imbalance.

A further advantage in terms of reducing such imbalance is obtained by the infinite adjustability of the holder and which can be accomplished in synchronism and automatically with the adjustment of the balancing mass or weight.

The operative coupling of the centrifuge arm drive and the cover member, upon closure thereof, prevents access of the operating personnel to the rotating centrifuge arm. The timing element or a standstill monitor, for instance a centrifugal force switch, also prevents opening of the cover member during the slowing-down or run-out of the centrifuge arm. The infeed of the measuring and energy lines or conductors to the heating element of the melting crucible and through the motor shaft is of advantage, because following the heating operation it is unnecessary to remove the connections before there can be initiated the centrifugal casting operation.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
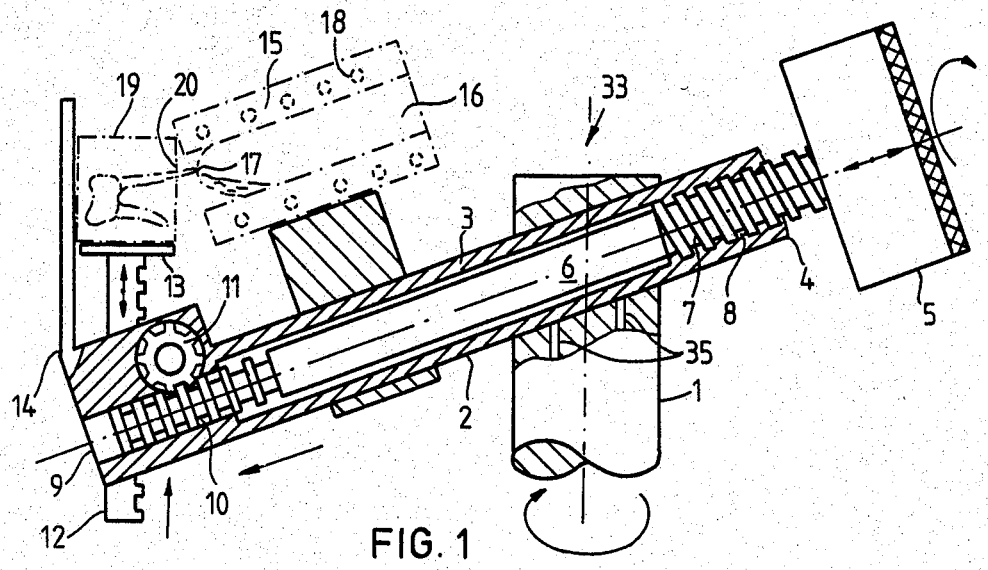
FIG. 1 illustrates, partially in section view, a preferred embodiment of centrifugal casting arrangement for a centrifugal casting machine and containing a centrifuge or centrifugal arm equipped with a muffle or retort holder and a compensation or balancing mass.

Describing now the drawings, it is to be understood that only enough of the construction of the centrifugal casting machine has been depicted in the drawings as needed for those skilled in the art to readily understand the underlying principles and concepts of the present development, while simplifying the illustration of the drawings. Turning attention now to FIG. 1, there is shown a centrifugal casting arrangement 33 for use in a centrifugal casting machine, especially for dental applications. The centrifugal casting arrangement 33 is secured upon a rotatable drive shaft 1 which serves to rotatably drive such centrifugal casting arrangement 33. The drive shaft 1 may be hollow, so that there can extend therethrough power or heating lines for a melting crucible or vat 16 and appropriate measuring elements, as generally schematically indicated by reference character 35 in FIG. 1. A centrifuge or centrifugal arm 2 in the form of a tubular member or pipe 3 of such centrifugal casting arrangement 33 is mounted in a plane which is inclined with respect to the horizontal. At the higher situated end or end region 4 of the tubular member or pipe 3 there is provided a balancing or compensation mass or weight 5. This balancing mass or weight 5 is secured to a drive rod or rod member 6 which is rotatably mounted within the tubular member 3 and is composed of different rod sections, as will be explained more fully hereinafter.

In particular, it will be observed that at the tube end 4 the drive rod member 6 is provided with a threaded portion or section 7 which engages with internal threads 8 provided within the related end portion of the tubular member or pipe 3. The external threads 7 at the drive rod 6 and the coacting internal threads 8 within the tubular member 3 provide a lengthwise displaceable connection of the drive rod member 6 together with the balancing mass or weight 5.

At the oppositely located end 9 of the centrifuge arm 2 the drive rod member 6 is provided with continuous gaps or recesses 10 which define tooth spaces with which mesh the teeth of a gear or pinion 11 mounted upon the centrifuge arm 2. There is also displaceably arranged with respect to the centrifuge arm 2, again at the arm end 9, a rod in the form of a gear rack 12 which can be displaced transversely, if desired at an inclination, with respect to the centrifuge arm 2. This gear rack 12 meshes with the gear or pinion 11. At the upper end of the gear rack 12, which is guided so as to be laterally offset with respect to the drive rod member 6 there is located an essentially horizontally positioned muffle or retort holder or support 13. At the end 9 of the centrifuge arm 2 there is also mounted a holder member 14.

As has been schematically shown in broken or phantom lines in FIG. 1 a heating element 15 along with the melting crucible or vat 16 having an outlet or pouring opening or orifice 17 and a heating coil or winding 18 are provided. Additionally, there will be observed that a casting muffle or retort 20 having an infeed or filling opening or orifice 20 is arranged upon the muffle or retort holder 13. These elements are basically conventional and do not constitute part of the invention as such, and therefore need not here be further explained.

Figure 2:
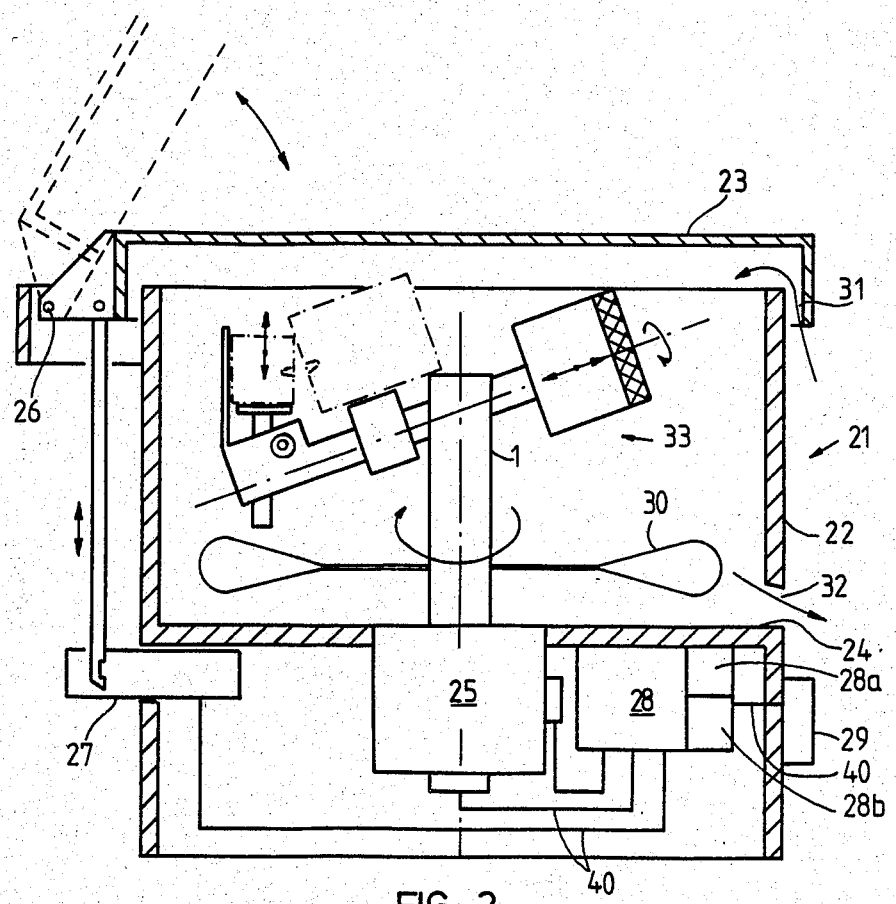
FIG. 2 is a schematic view, partially in section, depicting essentially the complete arrangement of centrifugal casting machine containing the centrifugal casting arrangement illustrated in FIG. 1 and the novel housing structure therefor.

The described centrifugal casting arrangement 33 of FIG. 1 is incorporated into a centrifugal casting machine 21, details of which have been depicted in FIG. 2. It will be observed that the centrifugal casting machine 21 comprises a housing structure containing a housing 22 and a cover member 23 for protectively closing the housing 22. At the intermediate floor or false bottom 24 of the housing 22 there is arranged a drive motor 25, to whose drive or output shaft there is flanged the drive shaft 1 of the centrifuge arm or arm member 2. The cover member 23, which is hingedly connected at the hinge or pivot joint structure 26, is operatively associated with a suitable cover opening facility, for instance a magnetic lock or latching mechanism 27 powered by alternating-current and delivering a signal indicating to an operator that the cover member can be opened. Extending from a control cabinet or box 28, which contains a suitable timing element or time-switching mechanism 28*a*, for instance a timing relay or timer mechanism, and the requisite relay means 28*b* or the drive motor 25, and which control cabinet 28 is also operatively associated with the magnetic lock mechanism 27 for the cover member 23, are the feed or supply lines 40 leading to the aforementioned drive means as well as to a primary switch 29 having suitable control lamps or indicators and arranged at the front side of the centrifugal casting machine 21.

There also can be arranged upon the drive shaft 1 a ventilator impeller or vane arrangement 30, and in the housing 22 there can be provided air slots 32 for circulating air through such housing 22. The cover member 23 preferably does not sealingly close the housing or housing member 22, and thus, leaves free an air gap or space 31.

In the description to follow there will now be considered the mode of operation of the centrifugal casting machine 21 and its centrifugal casting arrangement 33 as previously described. An empty muffle or retort 19 is placed upon the muffle holder or support 13 and the balancing mass or weight 5 is rotated for such length of time until the muffle 19 assumes the requisite elevational position where its inlet or filling opening 20 registers with the outlet or pouring opening 17 of the melting crucible 16. During rotation of the balancing mass or weight 5 such either moves outwardly, if there has been mounted a large-size muffle or retort 19, or inwardly if there is being used a smaller size muffle or retort 19. The pitch of the external threads 7 and internal threads 8 of the drive rod member 6 and tubular member 3 as well as also the tooth pitch at the gear or pinion 11 and the pitch of the tooth gaps or spaces 10 at the other end of such drive rod member 6 and the pitch of the teeth at the gear rack 12 are, of course, designed such that the mass of the momentarily mounted muffle or retort 19 is opposed by a corresponding balancing mass which prevents or markedly reduces any imbalance in the centrifuge arm 2.

The slight inclination of the centrifuge arm 2 ensures that the center of gravity of the mass of the muffle or retort 19 essentially comes to lie or revolve in the same rotational plane as the center of gravity of the balancing mass or weight 5. Consequently, there can be obtained not only a static, but especially also a dynamic equilibrium.

The centrifugal casting machine 21 depicted in FIG. 2 along with the therein mounted centrifugal casting arrangement 33 as previously described in detail with reference to FIG. 1 operates in the following manner:

While the cover member 23 is open the heating coil or winding 18 melts the metallic material located in the melting crucible 16. If the operator or, in fact, a suitable measuring element determines that there has been reached the required temperature, then the cover member 23 is closed. Immediately after closure of the cover member 23 the drive motor 25 places into rotation the centrifuge arm 2 for a time period or interval $t_1$ which can be adjusted by the control cabinet or arrangement 28. After starting the rotational movement of the centrifuge arm 2 the liquid metal is propelled through the infeed opening or orifice 20 into the casting muffle or retort 19 and is then solidified therein. After expiration of the set or adjusted time $t_1$ the drive motor 25 is switched-off and after a further previously predetermined set time interval or time $t_2$ or by means of a conventional and therefore not particularly shown standstill indicator, the cover member 23 is opened by the magnetic lock or locking mechanism 27. The opening operation can be optionally indicated either acoustically or optically if desired.

By prior experimentation and the application of suitable markings it is possible to determine and readily indicate the appropriate position for the balancing mass or weight 5 for the momentarily selected muffle or retort size (mass).

While there are shown and described present preferred embodiments of the invention, it is to be distinctly understood that the invention is not limited thereto, but may be otherwise variously embodied and practiced within the scope of the following claims. Accordingly,

What we claim is:

1. A centrifugal casting arrangement for a centrifugal casting machine, especially for dental applications, comprising:

a drive shaft;

a centrifuge arm operatively connected with said drive shaft;

said centrifuge arm having opposed end portions;

a muffle holder;

means for mounting said muffle holder so as to be movable essentially in vertical direction at one end portion of said centrifuge arm;

said mounting means including an essentially vertically disposed rod member;

a balancing mass displaceably mounted at the other end portion of said centrifuge arm for compensating for imbalance during use of different size casting muffles;

a melting crucible having a pouring opening and cooperating with said centrifuge arm for casting molten metal into a muffle mounted at said muffle holder; and drive connection means for operatively interconnecting said muffle holder and said balancing mass with one another such that during adjustment of the muffle holder to the size of a momentarily mounted casting muffle upon said essentially vertically disposed rod member for accommodating the casting muffle to the position of the casting opening of the melting crucible, the balancing mass is displaced synchronously to a location at the centrifuge arm which serves to balance the mass of the momentarily mounted casting muffle.

2. The centrifugal casting arrangement as defined in claim 1, wherein:

said drive connection means comprises threaded rod means extending through said centrifuge arm and carrying said balancing mass and cooperating with said rod member;

said centrifuge arm having threaded portions; and said threaded rod means cooperating with the threaded portions of said centrifuge arm such that due to relative rotation between said threaded rod means and said centrifuge arm said muffle holder can be infinitely displaced essentially in vertical direction.

3. The centrifugal casting arrangement as defined in claim 2, wherein:

said drive connection means further comprises gear means provided for said centrifuge arm and serving to establish a drive connection between said muffle holder and said balancing mass.

4. The centrifugal casting arrangement as defined in claim 3, wherein:

said gear means comprises said threaded rod means which defines a threaded rod member fixedly connected with said balancing mass and mounted to be lengthwise displaceable and rotatable in said centrifuge arm by means of said threaded portions of said centrifuge arm;

said gear means further comprising a gear cooperating with said essentially vertically disposed rod member;

said essentially vertically disposed rod member defining a gear rack secured to said muffle holder; and said gear driving said gear rack so as to be elevationally displaceable relative to said centrifuge arm.

5. The centrifugal casting arrangement as defined in claim 1, wherein:

said centrifuge arm is secured at an inclined position with respect to a horizontal at said drive shaft in such a manner that the center of gravity of the balancing mass is located essentially in the same plane of rotation as the center of gravity of the mass of the momentarily employed muffle.

* * * * *